US010050366B2

(12) United States Patent
Chevreau et al.

(10) Patent No.: US 10,050,366 B2
(45) Date of Patent: Aug. 14, 2018

(54) SLEEVE FOR SOCKET CONTACT, CONNECTOR USING THE SLEEVE, AND MANUFACTURING METHOD

(71) Applicant: EAXTRON (SARL), Paris (FR)

(72) Inventors: Mathieu Chevreau, Tours (FR); Marnix Van Der Mee, Montlouis sur Loire (FR)

(73) Assignee: EAXTRON (SARL), Paris (FR)

( * ) Notice: Subject to any disclaimer, the term of this patent is extended or adjusted under 35 U.S.C. 154(b) by 0 days.

(21) Appl. No.: 15/479,475

(22) Filed: Apr. 5, 2017

(65) Prior Publication Data

US 2017/0324181 A1 Nov. 9, 2017

(30) Foreign Application Priority Data

May 3, 2016 (FR) ..... 16 54007

(51) Int. Cl.

| | |
|---|---|
| ***H01R 13/187*** | (2006.01) |
| ***H01R 13/02*** | (2006.01) |
| ***H01R 13/193*** | (2006.01) |
| ***H01R 13/10*** | (2006.01) |
| ***H01R 13/53*** | (2006.01) |

(52) U.S. Cl.
CPC ..... *H01R 13/10* (2013.01); *H01R 13/53* (2013.01); *H01R 2201/26* (2013.01)

(58) Field of Classification Search
CPC .... H01R 13/187; H01R 13/111; H01R 13/02; H01R 4/4881; H01R 13/193; H01R 43/16; H01R 13/33; H01R 2101/00; H01R 43/20; H01R 13/18; H01R 13/53; H01R 24/20; H01R 13/40; H01R 13/415; H01R 13/422
See application file for complete search history.

(56) References Cited

U.S. PATENT DOCUMENTS 4,039,238 A * 8/1977 Johnson, Jr. ..... H01R 13/187 439/843
5,033,982 A 7/1991 Lucas
5,591,039 A * 1/1997 Matthews ..... H01R 13/53 439/181

(Continued)

FOREIGN PATENT DOCUMENTS

CN 104362452 A 2/2015
EP 0442693 A2 8/1991

(Continued)

OTHER PUBLICATIONS

Search Report for the French priority application.

*Primary Examiner* — Michael A Lyons
*Assistant Examiner* — Matthew T Dzierzynski
(74) *Attorney, Agent, or Firm* — Egbert Law Offices, PLLC

(57) ABSTRACT

Disclosed is a sleeve for a female contact, its method of manufacture, and also a connector using the sleeve. The sleeve is provided with a first end and a second end presenting, respectively, a rotary symmetry around a common axis, the ends being inter-connected by a plurality of contact blades. Each contact blade presents connecting sections linking the median part of the blade to the first and the second end respectively. The connecting sections describe at least one truncated surface. Applications include the implementation of connectors for high intensity currents, usable especially for electric vehicles.

10 Claims, 4 Drawing Sheets

(56) References Cited

U.S. PATENT DOCUMENTS

| | | | | |
|---|---|---|---|---|
| 5,601,457 | A * | 2/1997 | Le Gall | H01R 13/187 439/843 |
| 5,921,822 | A * | 7/1999 | Kennedy | H01R 13/187 439/851 |
| 6,042,432 | A * | 3/2000 | Hashizawa | H01R 13/187 439/843 |
| 6,254,439 | B1 * | 7/2001 | Endo | H01R 13/187 439/843 |
| 6,358,104 | B2 * | 3/2002 | Daugherty | H01R 13/187 439/851 |
| 6,520,998 | B1 * | 2/2003 | Scholler | H01R 13/187 439/843 |
| 6,783,406 | B2 * | 8/2004 | Keiser | H01R 4/4881 439/827 |
| 7,387,548 | B2 * | 6/2008 | Takehara | H01R 13/187 439/843 |
| 7,393,252 | B2 * | 7/2008 | Ribeau | H01R 13/187 439/843 |
| 8,142,238 | B2 * | 3/2012 | Heigl | H01R 13/111 439/843 |
| 9,257,769 | B2 * | 2/2016 | Ito | H01R 13/187 |
| 9,455,514 | B2 * | 9/2016 | Hirakawa | H01R 13/02 |
| 2012/0040555 | A1 | 2/2012 | Shih et al. | |
| 2016/0226181 | A1 * | 8/2016 | Sturgess | H01R 4/4881 |

FOREIGN PATENT DOCUMENTS

| | | | |
|---|---|---|---|
| EP | 2280455 | A1 | 2/2011 |
| GB | 2065993 | A | 7/1981 |
| JP | H03291874 | A | 2/2012 |

* cited by examiner

SLEEVE FOR SOCKET CONTACT, CONNECTOR USING THE SLEEVE, AND MANUFACTURING METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a metallic sleeve usable for forming a contact of a female electric connector. It also concerns a manufacturing method for such a sleeve as well as an electric connector equipped with the sleeve.

The invention finds applications in the general field of electric connectors and in particular power connectors. Power connectors are connectors susceptible to transmit currents of over a hundred ampere, or even several hundreds up to one thousand ampere.

A particular application of the invention is the production of electric connectors for connecting electric vehicles to a power supply battery and to connect the power supply battery to a charge unit for the battery.

The invention notably finds an application in the production of electric connectors for electric forklifts.

2. Description of Related Art Including Information Disclosed Under 37 CFR 1.97 and 37 CFR 1.98

Traditionally, electric connectors feature a female contact element, for example a socket and a male contact element, for example a contact pin, susceptible of being inserted into the socket so as to establish a temporary contact for the passage of an electric current. The electric contact is broken when the male element and the female element of the electric connector are separated. A triple technical problem arises traditionally in the production of such electric connectors.

A first technical, primordial problem is the quality of the electric contact between the male and female contact elements when they are assembled. In effect, an insufficient or defective contact is likely to generate an electric resistance to the passage of current and overheating due to the Joule effect. This problem is all the more critical when the electrical currents to transmit are very high.

A second technical problem is that of the hardness or "heftiness" of the connectors. It is a question of the force necessary to exert on the complementary connectors to insert or separate the male and female contact elements. Elevated hardness of the connectors makes their use unwieldy. This difficulty increases also with the intensity of the electric current to be transmitted. In effect, a significant electric current leads to larger dimensions of the contact elements and a larger contact surface. This leads to higher friction and greater difficulty with inserting or separating the contact elements. Accessorily, the search for improved quality of the electric contact can lead to reducing the play between the male and female contact elements and also increase the hardness of the connectors. In other words, the contact quality, and the ease of insertion or separation of the connectors seem to be at cross purposes.

A third technical problem is the durability of the connectors. Durability is understood to be the number of insertion and separation cycles of the complementary connectors during which the contact quality and the transport of current of a predetermined intensity can be guaranteed. Durability is also linked to the hardness of the connectors and the intensity of the currents to be transmitted.

One is familiar with connectors using a female contact element in the form of a socket including contact blades and in particular hyperboloid contact blades. Such connectors are known, for example from the documents CN 104 362 452 or U.S. Pat. No. 5,033,982. The multiple-blade socket aims for increasing the number of contact points between the female part and the male part of the connectors while limiting the mutual friction between these parts.

BRIEF SUMMARY OF THE INVENTION

The invention takes as its starting point an assessment that the hyperboloid blade connectors can turn out to be unsuitable or inadequate for the transmission of high intensity currents, particularly when the connectors are of modest size.

Furthermore it turns out that a certain number of blade contact connectors such as mentioned before present insufficient durability. The blades are subject, after a certain number of connections/disconnects, to deformation which, even if only slight, no longer guarantees the quality of the contact and the transmission of high currents.

The aim of the present invention is to propose a sleeve for socket contact and a connector using the sleeve that allow the transfer of a high intensity current and which presents low hardness and good durability.

One aim of the invention is also to propose a sleeve which allows the production of connectors of reduced size.

Another aim of the invention is to propose an assembly of male-female connectors adapted for high-power applications for vehicles and in particular electric forklifts.

Finally, the invention aims to propose a manufacturing method for a contact sleeve.

In order to achieve these aims, the invention concerns more precisely a metallic sleeve for a female contact. The sleeve is provided with a first end part and a second end part presenting respectively a rotational symmetry around a common axis and presenting respectively a first and a second diameter. The first and the second end parts are connected to each other by a plurality of contact blades. The median parts of the contact blades are parallel to the common axis and are fitted along a median cylinder, centered on said common axis and presenting a diameter smaller than the first and the second diameters. Each contact blade presents connection sections linking the median part of the blade respectively to the first and the second end part, the connecting sections of the contact blades extending between the median cylinder and the first and second end parts while describing at least a truncated surface. Incidentally, the connecting sections of each contact blade form an angle in relation to a plane passing through the contact blade and the common axis respectively.

In the case of a symmetric sleeve, the connecting sections describe a truncated surface between the median part of the blades, corresponding to the median cylinder and each of the first and second end parts. It is however possible for the connecting sections to describe a truncated surface only in one of the end parts of the sleeve.

One considers that the median part of the contact blades is fitted along the median cylinder when they extend essentially over a surface defined by a generating line of a cylinder running a circle centered on the common axis. This surface is thus parallel to the common axis. Thanks to this characteristic, the blades, and more exactly their median parts, are likely to present an optimal contact surface with a cylindrical pin of a corresponding male connector, inserted coaxially to the common axis. It must be stressed that the median cylinder is not a material cylinder but an immaterial cylinder defined by the median parts of the blades.

Furthermore, the layout of the connecting sections along a truncated surface provides radial flexibility to the contact blades while maintaining the flatness of their median parts and their layout along an essentially cylindrical surface. In this way, at the insertion of a male pin, the flexibility provided by the connecting sections allows to slightly increase the diameter of the median cylinder, without deforming the median part of the blades. This results in great softness of the insertion or withdrawal of the pin while guaranteeing a quality electric contact.

The truncated form with its large base turned towards the end parts with larger diameter provides furthermore a guide that facilitates the introduction of a male pin in the cylindrical housing defined by the median part of the contact blades.

As mentioned earlier, the connecting sections of each contact blade form respectively an angle relative to a plane passing through the contact blade and the common axis. In other words, for each blade, the median part and the connecting sections are not coplanar in a plane passing through the common axis. The connecting angle is, for example, an angle between 30 and 60 degrees.

This characteristic allows a further increase of the flexibility provided by the connecting sections and the softness of insertion or withdrawal of the pin in a sleeve. It also allows the median parts of the blades to have contact with the pin over their entire length, parallel to the axis of the pin and without deforming themselves, so as to ensure an electric contact of quality with the pin. This also results in increased durability of a connector equipped with the sleeve.

The median parts of the contact blades extend parallel to a generating line of the median cylinder which they delimit and are parallel to the common axis.

The contact blades can present sections of different shapes, with a preference however for a thin and flat shape. The median parts of the contact blades can thus present a wide side perpendicular with respect to a radius of the median cylinder. This wide side, possibly slightly curved along the curvature of the median cylinder, can in this case apply itself tangentially to the surface of a male pin, when such a pin is inserted into the sleeve.

The end parts of the sleeve can be cylindrical parts, with a diameter equal to the first and to the second diameter respectively.

According to another possibility the end parts can present a truncated shape, in a comparable manner to the connecting sections. The truncated cones flare from a small base presenting the first and the second diameter respectively as previously mentioned, the small base being turned towards the contact blades. In this case, the end parts of the sleeve prolong a cone formed by the connecting sections to guide a pin that is to be inserted into the sleeve.

As described further down, the end parts of the sleeve can be used advantageously to form a permanent electric contact with other conductors of a connector, and can thus, in a more general way, present a shape adapting itself to these conductors.

Accessorily, the sleeve can also be equipped with one or several connection terminals so a conductor can be connected to it, and in particular an electric cable.

In a preferred implementation of the sleeve, the sleeve is symmetrical in relation to a median plane perpendicular to the common axis. Consequently, the first and second diameters of the end parts can be the same.

The number of contact blades is preferably adapted to the intensity of the current susceptible to be transmitted by a connector receiving the sleeve. The number of blades is, for example, between 10 and 18.

For illustrative purposes, a connector for a current of 160 A can be equipped with a sleeve with 12 contact blades. For a nominal current of 320 A the number of blades can be raised up to 14.

The sleeve can be made preferably of metal such as bronze, phosphor bronze, beryllium copper, or nickel silver, for example.

As mentioned earlier, the invention also concerns a connector including one or several sleeves such as described above.

In a particular implementation of the connector, it may include at least one socket presenting a cylindrical bore, the sleeve being housed in the bore. The connector can include one or several sockets, depending on the number of phases of the current or currents to be transmitted and the number of connector terminals. For direct current, the bipolar connector can feature two sockets, each provided with a sleeve as described.

A socket is to be understood as being an intermediate metallic part intended to connect electrically the sleeve to a conductor such as an electric cable for example. Such a socket is used when the sleeve does not present in itself any connection terminal for an electric cable.

When the sleeve is inserted into the bore of the socket, the first and second end parts allow establishing a permanent electric contact with the socket and hence with conductors that are connected there.

In order to keep the sleeve in the bore, the bore can present a shoulder, for example, a cylindrical or conical shoulder, forming a stop for at least one of the first and second end parts of the sleeve. In other respects, after the introduction of the sleeve into the bore of the socket, the sleeve can be crimped in the socket by deformation of the socket, and notably of its end, to slightly reduce its diameter.

The invention also concerns an assembly of male and female connectors, including a female connector as described above, and a male connector with a cylindrical contact pin presenting a diameter included between the diameter of the median cylinder of the sleeve and the smaller of the first and second diameters of the end parts of the sleeve.

The connectors can also feature insulating casings surrounding the socket, the sleeve and possibly other metallic parts susceptible to be exposed to electric power. The insulating casings of the male and female connectors may also feature complementary non-metallic parts, contributing to the quality of the assembly of the connectors and the security of the connection.

In particular, complementary connectors may include a connection lock capable of maintaining the male connector in position in the female connector.

Finally, the invention concerns a method of manufacturing a female contact sleeve, in particular a sleeve such as described above.

The method includes:

The flat cutting of a metal plate according to a pattern including two full side strips extending between a first and a second end of the plate, the side strips being parallel to each other, and interconnected by a plurality of contact blades forming crosspieces, uniformly spaced to each other and connected with respect to the side strips by connecting sections, the median parts of the contact blades being perpendicular to the side strips, and the connecting sections of the contact blades forming an angle with the median part of the contact blades, and the rolling of the metal plate so as to join together the first and second ends of the metal plate and fit the median part of the contact blades along a cylinder.

This cylinder corresponds to the median cylinder mentioned in reference to the description of the sleeve.

During the rolling process, the side strips may be fitted respectively along a second cylinder, or along a truncated cone presenting a radius greater than the median cylinder.

Advantageously, as the median cylinder presents a smaller diameter than that of the end parts, the effect of the rolling is to bring the contact blades closer together and in particular their median parts, after their cutting. The effect of the blades coming closer together is to reduce a clearance between the median parts of the blades on the surface of the median cylinder. It favors the passage of an electric current as well as evacuation of the heat produced by the passage of an electric current. In other respects, the median parts of the contact blades retain their perpendicular character with respect to the side strips and are thus fitted parallel to the common axis of the median cylinder obtained after the rolling.

After the rolling, the first and second ends of the metal plate can be joined together by welding. Execution of a weldment is however not indispensable. In particular, when the sleeve is crimped into a socket, in the manner described above, the crimping operation can be used to perfectly join together the first and second ends of the plate being formed into the sleeve. A weldment is then superfluous.

Other characteristics and advantages of the invention become clearer in the following description, with reference to the figures of the drawings. This description is for illustrative purposes only and not limiting.

DETAILED DESCRIPTION OF THE INVENTION

In the following description, all identical, similar or equivalent parts of the different figures are identified by the same reference marks so one can refer from one figure to the other.

Figure 1:
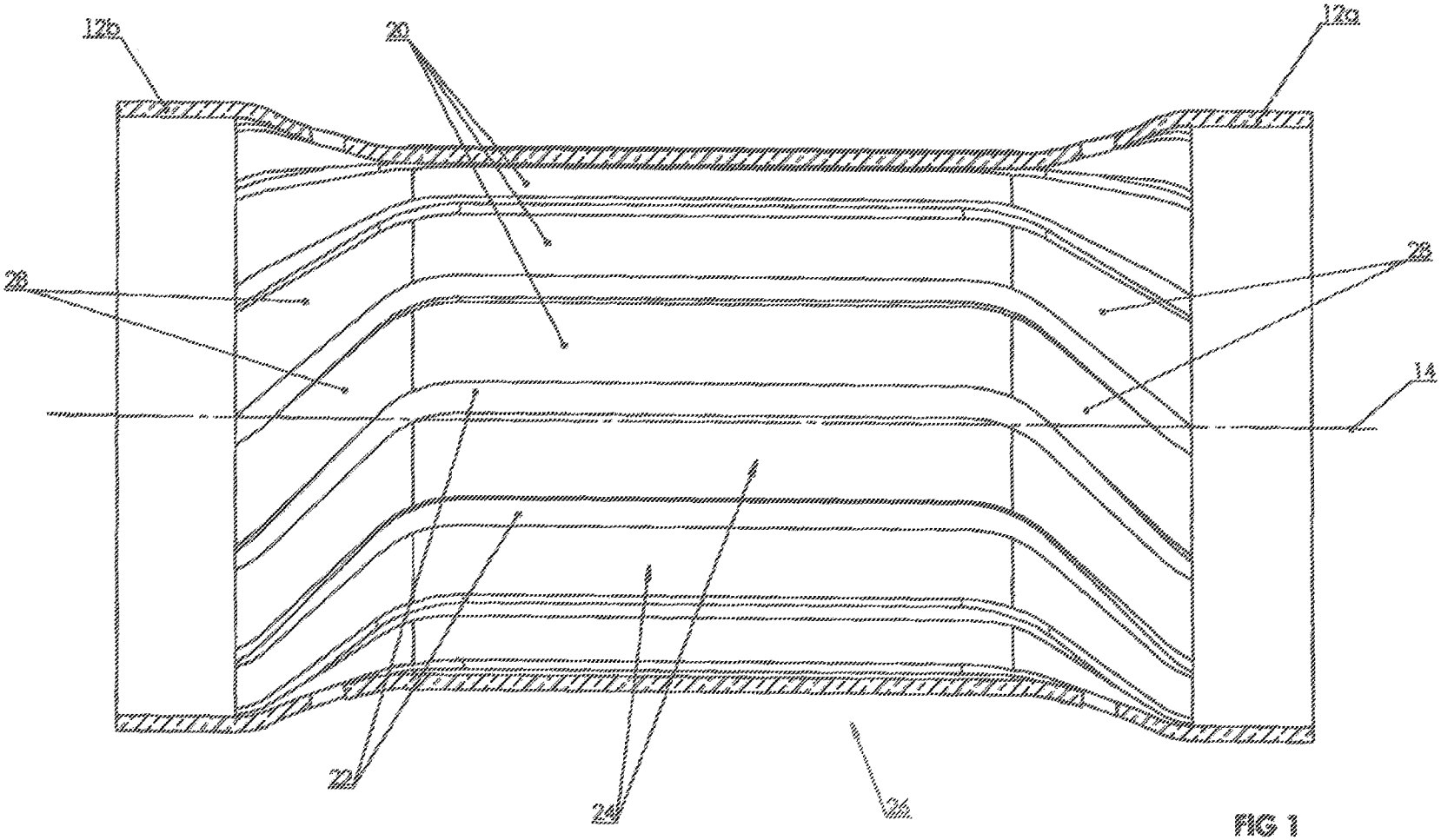
FIG. 1 is a side view of a metal sleeve for female contact, according to the invention.

FIG. 1 shows a metal sleeve 10 according to the invention. The sleeve is usable as a female contact element of a connector.

The sleeve 10 presents a first end part 12*a* and a second end part 12*b* presenting a first and a second diameter respectively. In the example of implementation of FIG. 1, the first and the second diameters are the same. This common diameter is greater than the diameter of a male contact pin susceptible of being received in the sleeve.

The end parts 12*a* and 12*b* present a rotary symmetry around an axis 14 designated as "common axis". In the particular case of the sleeve of FIG. 1, the end parts 12*a* and 12*b* are cylindrical.

The end parts 12*a* and 12*b* of the sleeve 10 are interconnected by a plurality of contact blades 20, identical to each other and separated from each other by regular spaces 22.

The contact blades 20 each present a plane median part 24 and are fitted along a rotary symmetry around the common axis 14 so that the median parts 24 of the blades define a cylinder 26 designated as the median cylinder.

The diameter of the median cylinder 26 is smaller than the diameter of the end parts 12*a* and 12*b* of the sleeve 10. The diameter of the median cylinder is also slightly smaller than the diameter of a conjugated male contact pin, susceptible to be received in the sleeve.

The median parts of the contact blades 20 are respectively linked to the first and the second end part 12*a*, 12*b* by connecting sections 28. The connecting sections extend between the median cylinder 26 defined by the median parts of the blades and the end parts 12*a*, 12*b*, by being fitted along truncated surfaces. The obliquely truncated cones described by the connecting sections present a small base corresponding to the median cylinder 26 and a large base corresponding to the diameter of the cylinders formed by the end parties 12, 12*b*. In the example of FIG. 1, the obliquely truncated cones defined by the connecting sections towards each end part are symmetrical relative to a median plane perpendicular to the common axis 14.

In other respects, and always in the example of FIG. 1, the median parts 26 of the contact blades 20 extend along a generating line of the median cylinder. The median part 24 of the contact blades 20 is thus essentially plane and parallel to the common axis 14.

On FIG. 1, one can observe that the connecting sections 28 are not in the extension of the contact blades 20 but form, respectively, an angle relative to these blades. More precisely, the connecting sections form an angle relative to a plane passing through the contact blades 20, and notably through the middle of the blades, and the common axis 14. The angle formed at the two ends of each blade is opposite.

It should be stressed that the transitions between the median part 24 of the contact blades 20 and the connecting sections 28, as well as the transitions between the connecting sections 28 and the end parts 12*a*, 12*b* are soft, curved transitions. They do not present a sharp edge susceptible of coming into contact with a conjugated male contact element.

The particular adaptation of the blades confers to the sleeve a suppleness allowing an insertion and withdrawal of a male contact element with low mechanical resistance while guaranteeing a good electric contact.

Figure 2:
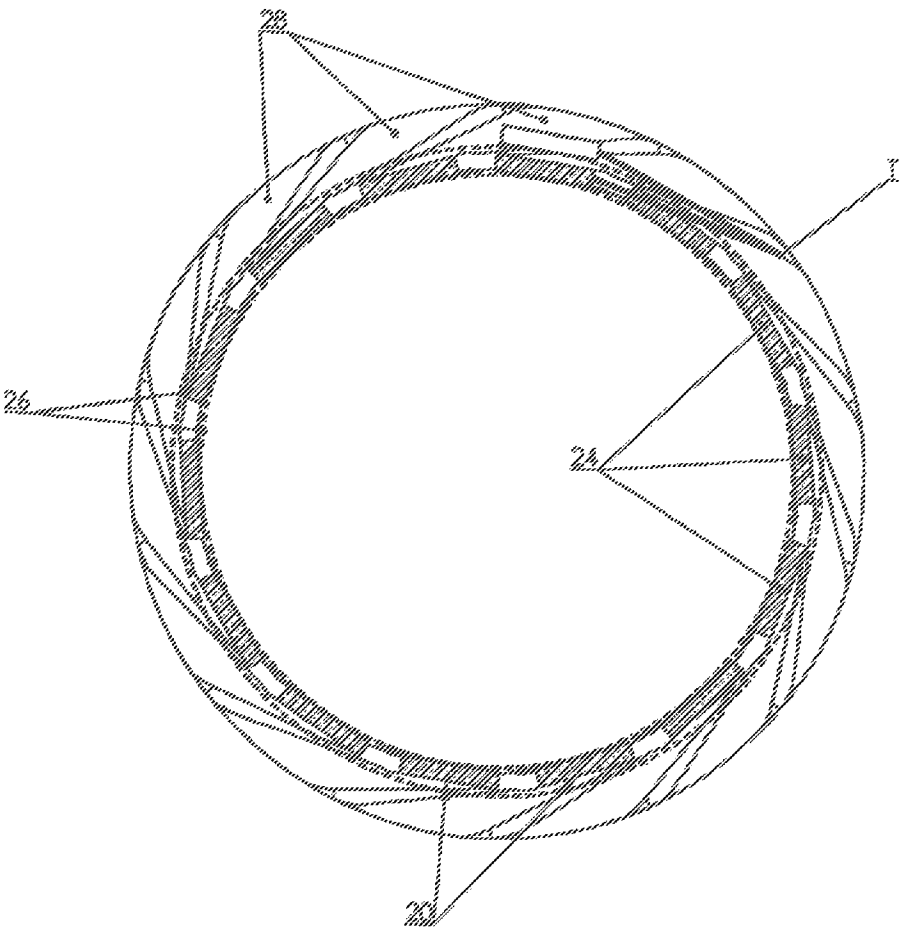
FIG. 2 is an axial view of the sleeve of FIG. 1.

As FIG. 2 shows, the suppleness of the sleeve derives from flexibility of the connecting sections 28. The flexibility is accompanied by a limited possibility of torsion of each connecting section around a torsion point T set off relative to the median part 24 of the corresponding blade respectively. This characteristic favors good durability of the sleeve.

The flexibility afforded by the connecting sections allows for slight variations of the diameter of the median cylinder 26 as indicated by the broken lines. This variation of the median cylinder occurs without deformation of the median part 24 of the contact blades 20. These remain plane and are essentially parallel to the common axis and a generating line of the median cylinder.

Figure 3:
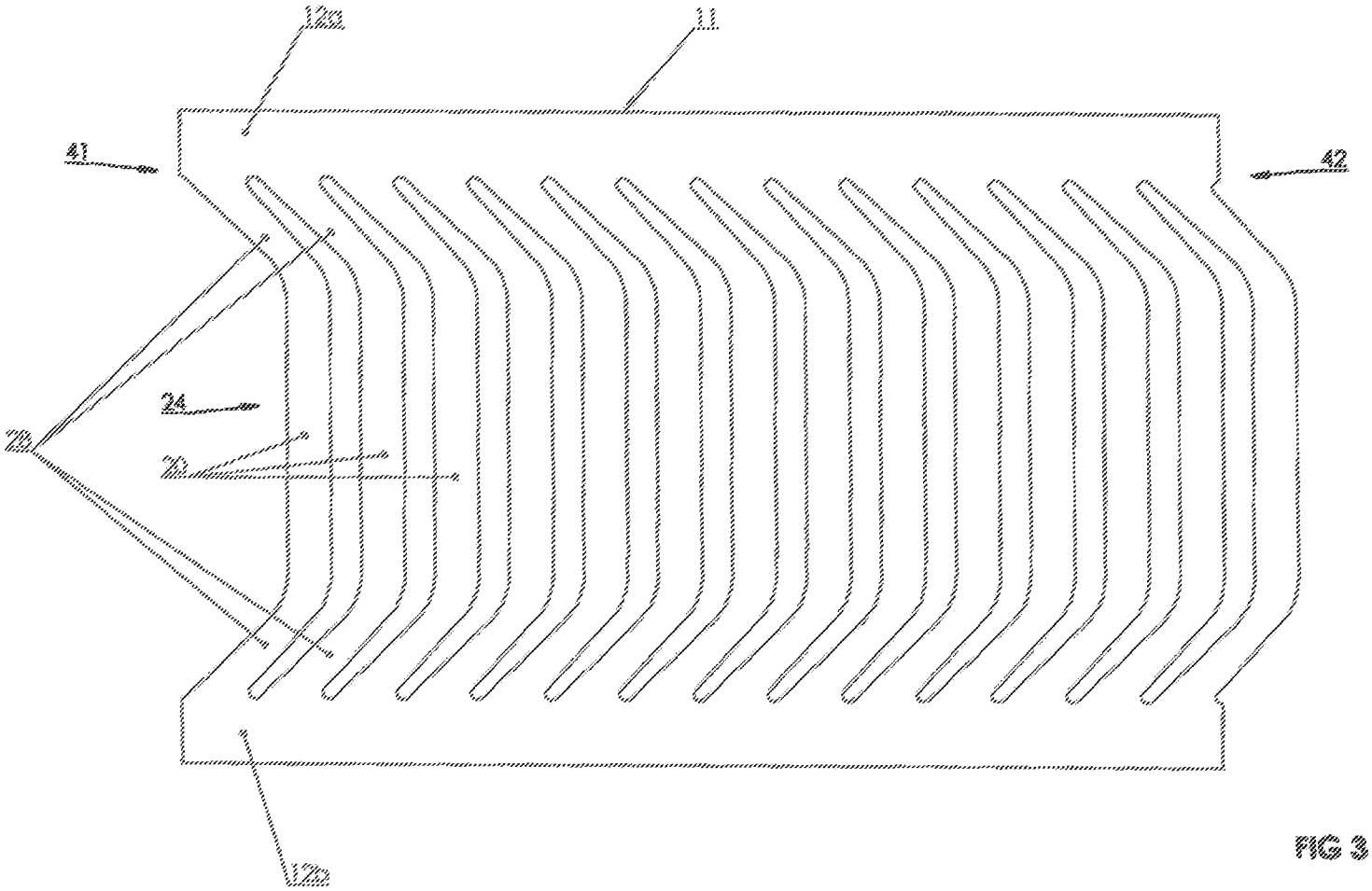
FIG. 3 is a front view of a metal plate used for the manufacture of a sleeve according to the invention.

FIG. 3 shows the result of a first manufacturing step of a sleeve as described previously. This step includes the cutting of a plate 11, for example by stamping to obtain the plate of FIG. 3. The plate 11 presents two side strips 12*a*, 12*b* which, after rolling, will form the afore-mentioned end parts 12*a*, 12*b* of the sleeve. As they are the same parts, they are designated by the same references.

Plate 11, and in particular the side strips 12*a*, 12*b* extend between a first and a second plate end. These ends are marked with the references 41, 42.

The side strips 12*a*, 12*b*, parallel to each other, are linked by the contact blades 20 which form crosspieces. The median parts 24 of the contact blades are also parallel to each other and regularly spaced. They are also perpendicular to the side strips 12*a*, 12*b* in the example of implementation shown.

One can also observe that the median parts 24 of the blade contacts 20 are connected to the side strips 12*a*, 12*b* by connecting sections forming an angle with the median parts. One considers that the connection sections form an angle relative to the median parts when this angle is an angle other than zero and not a right angle. Preferably the angle is between 30 and 60 degrees.

A second step of the manufacturing method includes the rolling of the plate so as to bring together the ends 41 and 42 of the plate. The rolling allows fitting the side strips 12*a*, 12*b*, so that they form the corresponding cylindrical end parts of FIG. 1. It also allows fitting the median parts 24 of the contact blades 20 along the median cylinder.

Figure 4:
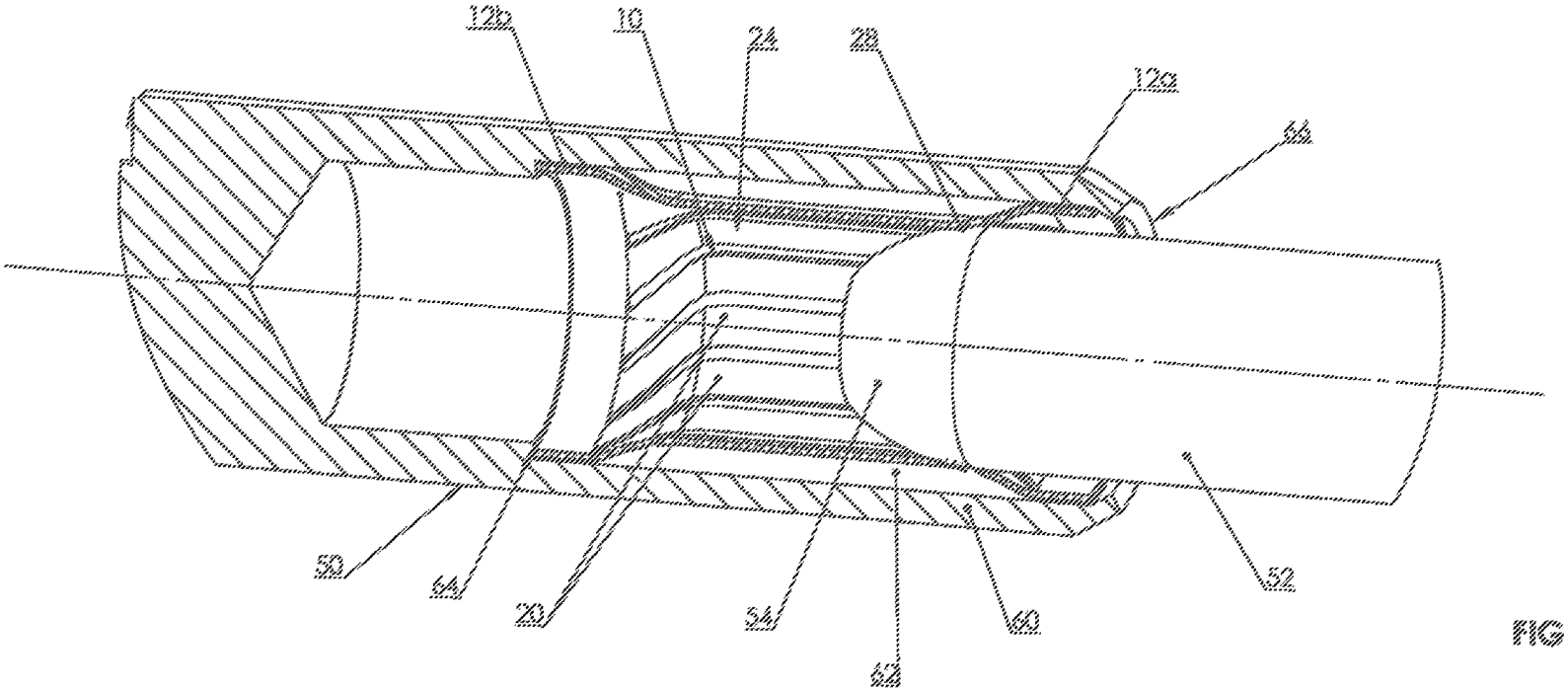
FIG. 4 is a partial view of an assembly of male and female connectors according to the invention and using the sleeve of FIG. 1 or 2.

FIG. 4 shows a detail of an assembly of connectors including a female connector 50 and a male connector of which only a cylindrical pin 52 is visible.

The female connector includes a socket 60 in a material such as copper covered with a fine layer of silver, brass, bronze, or aluminum, for example. The socket 60 is provided with a bore 62 receiving a sleeve 10 such as previously described. The bore presents a diameter essentially adjusted to the diameter of the end parts 12*a* and 12*b* of the sleeve.

The bore 62 of the socket includes a shoulder 64 against which one of the end parts 12*b* comes to rest. The other end part 12*a* of the sleeve, turned towards the opening 66 of the socket, is maintained by a slight conical shrinking of the opening of the socket made during a crimping operation of the sleeve in the socket. The end parts 12*a* and 12*b* of the sleeve form a permanent electrical contact between the sleeve 10 and the socket 60 of the female connector.

The diameter of the opening 66 of the socket, slightly less than the diameter of the end parts of the sleeve after its crimping, is greater than that of a pin 52 of the conjugated male connector.

The truncated part of the sleeve 10 formed by the connecting sections 28 in the vicinity of its end 12*a* turned towards the opening of the socket 66 constitutes a cone-shaped guide allowing, during the introduction of the pin 52, to guide it along the axis of the sleeve. The connecting sections cooperate with a rounded end 54 of the pin 52.

During the insertion of the pin 52, the latter is going to slightly bend the connecting sections 28 of the sleeve 10, thereby adjusting the median cylinder defined by the median parts 24 of the contact blades at the diameter of the pin 52 of the male connector. This allows an effortless introduction of the sleeve into the socket while ensuring an excellent electric contact between the median part 24 of the contact blades with the pin 52. The median parts of the contact blades 20 rest flat on the pin. Along a plane perpendicular to the axis of the sleeve, the median parts 24 of the blade contacts 20 rest tangentially on the surface of the pin 52, or indeed slightly curved to match the surface of the pin 52. The blades present in effect a wide side, visible on FIG. 2, essentially perpendicular to a corresponding radius of the median cylinder, or a radius of the pin when it is inserted.

The female connector and/or the male connector may be provided with casings in an electrically insulating material, for example of plastics, protecting the metal parts. The casings may particularly constitute a protection for an operator seizing the connectors. The casings are however not shown on FIG. 4, for reasons of simplification.

We claim:

1. A metal sleeve article for a female connector, the sleeve article comprising:

a first end part and a second end part having rotary symmetry around a common axis, said first end part having a first diameter, said second end part having a second diameter; and a plurality of contact blades interconnecting said first and second parts, each of said plurality of contact blades having a median part and connecting sections linking the median part respectively to said first and second end parts, the median parts being positioned along a median cylinder centered on the common axis and having a diameter less than the first and the second diameters of said first and second end parts, the connecting sections of said plurality of contact blades extending between the median cylinder and said first and second end parts by describing at least one truncated surface wherein the connecting sections of each of said plurality of contact blades share the common axis and form a non-zero angle relative respectively to a plane passing through a middle of the median part of the contact blade, wherein the median part is respectively parallel to said plane and to the common axis.

2. The metal sleeve article of claim 1, wherein the median parts of said plurality of contact blades have a wide side perpendicular to a radius of the median cylinder.

3. The metal sleeve article of claim 1, wherein said first and second parts are cylindrical.

4. The metal sleeve article of claim 1, wherein said first and second end parts have a truncated shape with a small base defining the first and second diameters respectively, the small base being toward said plurality of the contact blades.

5. The metal sleeve article of claim 1, said first and second diameters being identical.

6. The metal sleeve article of claim 1, said plurality of contact blades being between 10 and 18 contact blades.

7. A female connector having the metal sleeve article of claim 1.

8. The female connector of claim 7, further comprising:

at least one socket with a cylindrical bore, the metal sleeve article being housed in the cylindrical bore.

9. The female connector of claim 8, wherein the cylindrical bore has a shoulder defining a stop of at least one of said first and second end parts.

10. An assembly of a male connector and the female connector of claim 7, the male connector having a cylindrical contact pin having a diameter that is between a diameter of the median cylinder and a smaller diameter of the first and second diameters of said first and second end parts.

* * * * *